US010907660B2

(12) United States Patent
Jubert et al.

(10) Patent No.: US 10,907,660 B2
(45) Date of Patent: Feb. 2, 2021

(54) HYDRAULIC CIRCUIT FOR FEEDING AN ACTUATOR, IN PARTICULAR FOR USE IN MOVING A DOOR OF AN AIRCRAFT BAY

(71) Applicant: SAFRAN LANDING SYSTEMS, Velizy Villacoublay (FR)

(72) Inventors: Xavier Jubert, Moissy-Cramayel (FR); Sébastien Ernis, Moissy-Cramayel (FR)

(73) Assignee: SAFRAN LANDING SYSTEMS, Velizy Villacoublay (FR)

( * ) Notice: Subject to any disclaimer, the term of this patent is extended or adjusted under 35 U.S.C. 154(b) by 0 days.

(21) Appl. No.: 16/504,403

(22) Filed: Jul. 8, 2019

(65) Prior Publication Data

US 2020/0011352 A1 Jan. 9, 2020

(30) Foreign Application Priority Data

Jul. 9, 2018 (FR) ..... 18 56297

(51) Int. Cl.
*F15B 11/10* (2006.01)
*F15B 13/04* (2006.01)
*F15B 13/042* (2006.01)

(52) U.S. Cl.
CPC ..... *F15B 11/10* (2013.01); *F15B 13/0401* (2013.01); *F15B 13/042* (2013.01); *F15B 2211/255* (2013.01)

(58) Field of Classification Search
CPC ..... F15B 13/0401; F15B 13/0402; F15B 2013/0412; F15B 2013/0413;
(Continued)

(56) References Cited

U.S. PATENT DOCUMENTS 5,191,826 A * 3/1993 Brunner ..... B66C 13/18 60/460
5,259,293 A * 11/1993 Brunner ..... F15B 11/003 60/468
(Continued)

FOREIGN PATENT DOCUMENTS

EP 0 503 266 A1 9/1992
EP 2 071 195 A2 6/2009
(Continued)

OTHER PUBLICATIONS

French Preliminary Search Report for FR 18 56297 dated Mar. 21, 2019.

*Primary Examiner* — Dustin T Nguyen
(74) *Attorney, Agent, or Firm* — Sughrue Mion, PLLC

(57) ABSTRACT

The invention provides a hydraulic circuit for feeding an actuator (1) comprising first and second chambers (5, 6), the circuit comprising a slide valve (10) with a slide (16) that is movable between first and second extreme positions (18, 19) on either side of a stable central position (17) so that:

- in the central position, it connects the chambers (5, 6) of the actuator to a return port;
- in the first extreme position (18), it connects the first chamber (5) to a feed port and the second chamber to the return port; and
- in the second extreme position (19), it connects at least the second chamber (6) to the feed port.

According to the invention, the hydraulic circuit includes pressure-maintaining means (20) for maintaining pressure in the first chamber of the actuator while the slide is passing through the central position on being moved from the first extreme position to the second extreme position.

4 Claims, 4 Drawing Sheets

(58) Field of Classification Search
CPC ..... F15B 2013/041; F15B 2211/30515; F15B 2211/30525; F15B 2211/3111; F15B 2211/7053; F15B 2211/329; F15B 2211/40515; F15B 2211/30505; F15B 2211/3127; F15B 2211/428; F15B 2211/46; F15B 2211/50518; F15B 2211/31576; F15B 2211/40584; F15B 2211/41527; F15B 2211/3058; F15B 2211/327; F15B 2211/355; F15B 2211/5153; B64C 25/22; B64C 25/16; B64C 13/40
See application file for complete search history.

(56) References Cited

U.S. PATENT DOCUMENTS 5,263,400 A * 11/1993 Huesser ..... B66C 23/82 60/468
5,596,823 A * 1/1997 Clasen ..... E01H 5/06 37/232
6,792,844 B1 * 9/2004 Gedge ..... B64C 25/22 251/63.4
8,413,688 B2 * 4/2013 Bassoli ..... F15B 11/0445 137/601.18
10,459,117 B2 * 10/2019 Baumstein ..... G01V 99/005
2005/0199120 A1 * 9/2005 Bitter ..... B66F 9/065 91/446
2009/0142201 A1 * 6/2009 Lin ..... E02F 9/2296 417/280
2010/0083651 A1 * 4/2010 Hristov ..... E02F 9/2203 60/459
2012/0097792 A1 4/2012 Ernis et al.
2016/0061228 A1 * 3/2016 Lucas ..... F15B 20/005 60/431

FOREIGN PATENT DOCUMENTS

EP 2 444 317 A1 4/2012
EP 2 740 944 A2 6/2014

* cited by examiner

HYDRAULIC CIRCUIT FOR FEEDING AN ACTUATOR, IN PARTICULAR FOR USE IN MOVING A DOOR OF AN AIRCRAFT BAY

The invention relates to a hydraulic circuit for feeding an actuator, in particular for use in moving a door of an aircraft bay, such as a wheel well, or indeed for moving an undercarriage.

BACKGROUND OF THE INVENTION

Aircraft bay doors are generally moved by an actuator between an open position and a closed position in which the doors are held locked by a latching box. For this purpose, the actuator continues to pull on the door after it has reached its closed position in order to press it against the abutment that defines the closed position and thus lock it in a prestressed state. Thereafter, once the door is locked, the actuator ceases to act.

In order to open the door, the procedure begins by retracting the actuator to pull the door so as to make it easier to open the latch in the latching box. Thereafter the actuator is caused to extend. For this purpose, the slide valve that feeds the actuator passes via a central position in which both chambers of the actuator are connected to return, thereby suddenly reducing the traction that the actuator exerts on the door. The pulling force applied to the door by the actuator is released suddenly and the corresponding prestress propels the door until the actuator is pressurized once more and controls the door again, with this propulsion leading to bouncing. This bouncing induces pressure peaks in the chambers of the actuator and in the associated pipework, which can be damaging in terms of the ability of the actuator and of the structure of the aircraft to withstand fatigue.

OBJECT OF THE INVENTION

The invention seeks to propose a hydraulic circuit for feeding an actuator that reduced the risk of the load coupled to the actuator bouncing in the event of the load being propelled by a sudden release of stress, or indeed by its own weight when reversing the travel direction of the actuator.

SUMMARY OF THE INVENTION

In order to achieve this object, there is provided a hydraulic circuit for feeding an actuator having first and second chambers, the circuit comprising a slide valve with a slide that is movable between first and second extreme positions on either side of a stable central position so that:

in the central position, it connects the chambers of the actuator to a return port;

in the first extreme position, it connects the first chamber to a feed port and the second chamber to the return port; and in the second extreme position, it connects the second chamber to the feed port, the first chamber being connected either to the feed port or to the return port.

According to the invention, the hydraulic circuit includes pressure-maintaining means for maintaining pressure in the first chamber of the actuator while the slide is passing through the central position on being moved from the first extreme position to the second extreme position.

Thus, after the load has been pulled so as to be prestressed in order to facilitate unlatching it, the pressure-maintaining means prevent the first chamber of the actuator from depressurizing suddenly while the slide of the slide valve is passing through the central position, thereby keeping control over the load. The prestress can relax progressively without causing the load to move suddenly, thereby reducing any risk of bouncing.

In a preferred embodiment of the invention, the pressure-maintaining means comprise an on/off valve arranged on a line connecting the slide valve to the first chamber, this on/off valve including a slide that is movable between a closed position and an open position towards which the slide is urged by a spring, the on/off valve having at least two pilot chambers, including an opening chamber connected to the second chamber of the actuator and a closing chamber connected to the first chamber of the actuator.

The on/off valve is thus put into a closed position when the slide of the slide valve is in the first extreme position, thereby maintaining the first chamber of the actuator under pressure while the slide valve is passing through the central position as it passes from its first extreme position to its second extreme position. Thereafter, the on/off valve opens progressively under the action of the spring when the second chamber of the actuator is pressurized.

DESCRIPTION OF THE FIGURES

The invention can be better understood in the light of the following description of a particular embodiment of the invention given with reference to the accompanying figures, in which.

Figure 3:
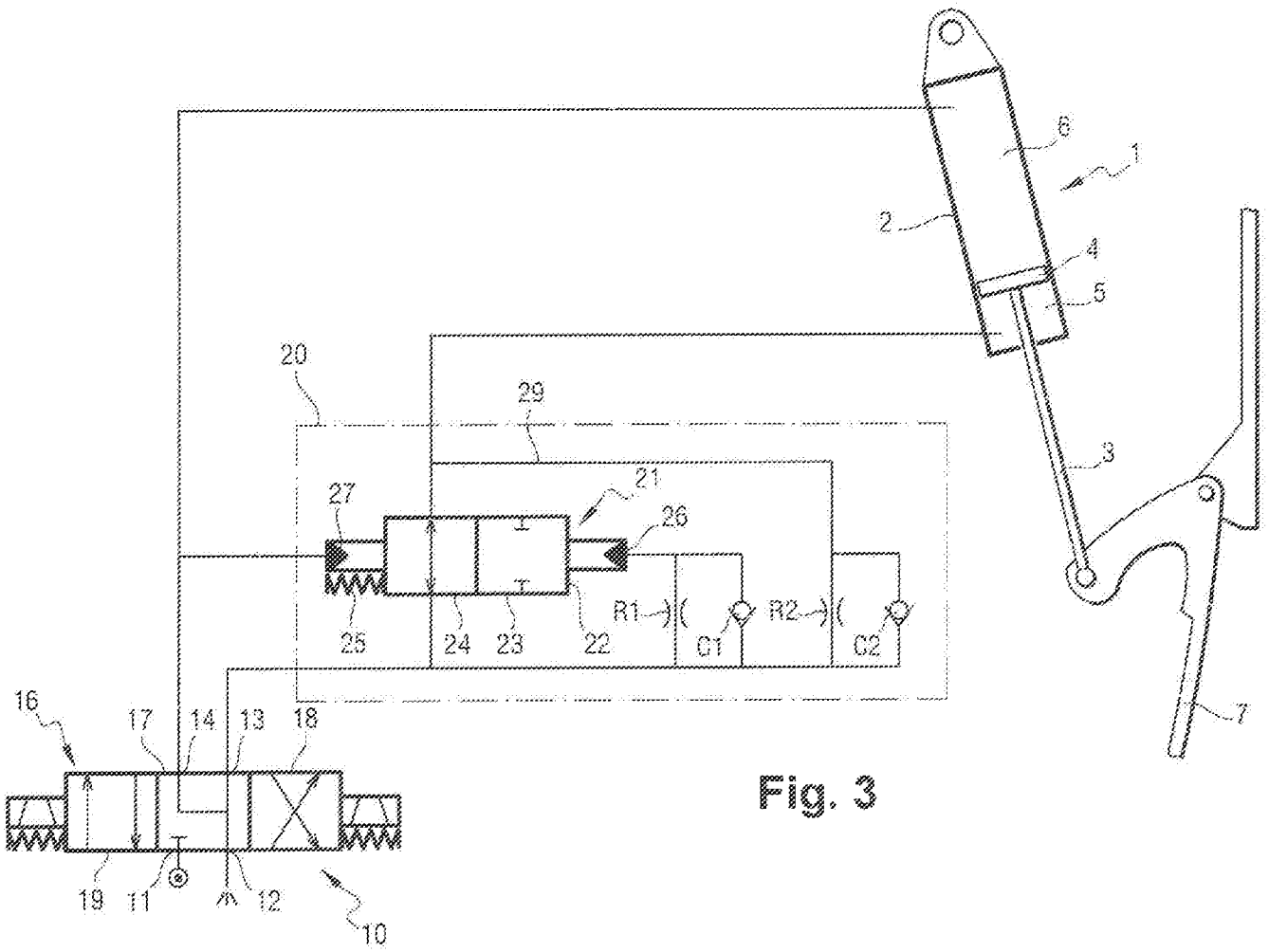
Figure 4:
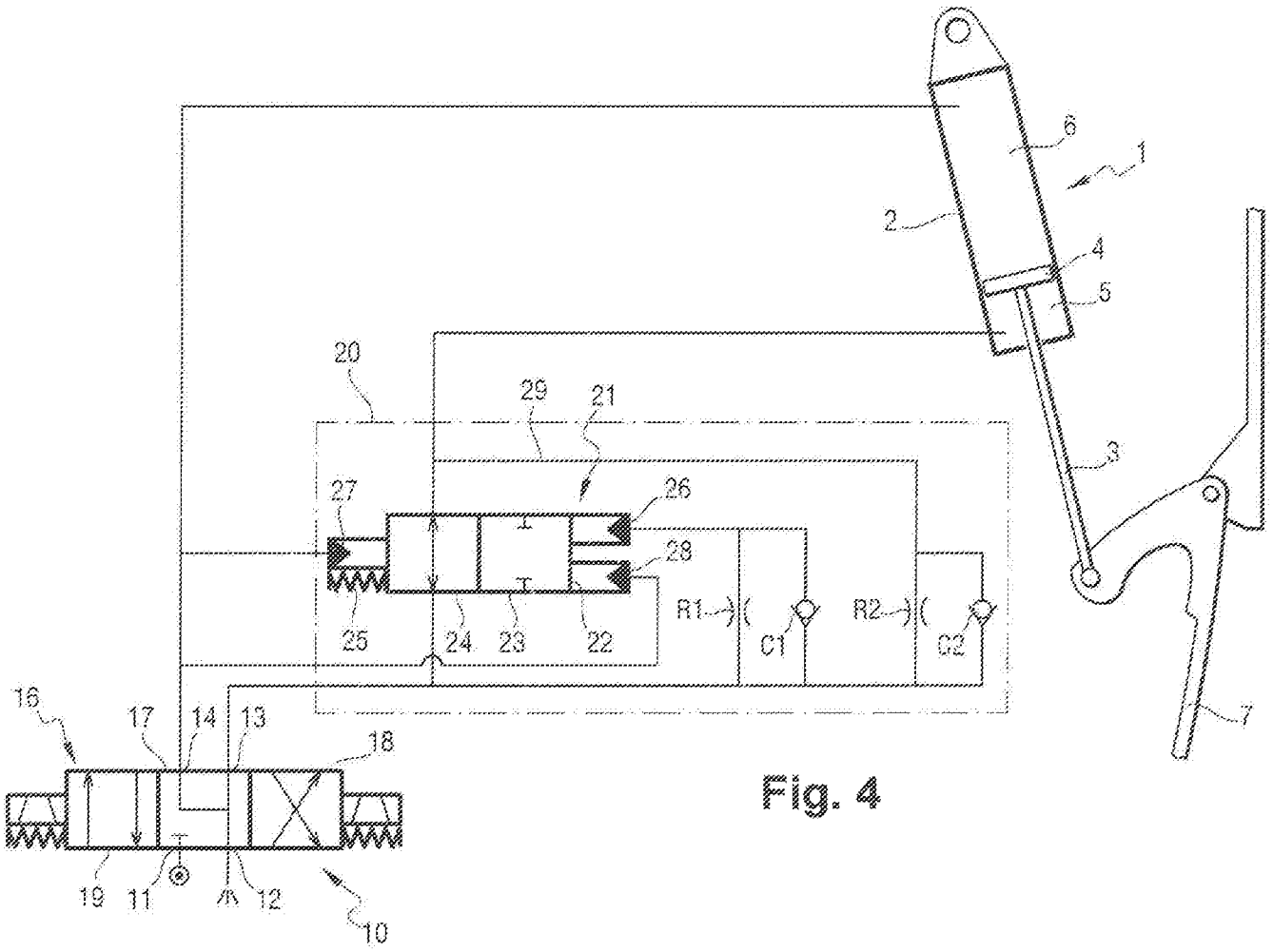

- the pressure in the retraction chamber of the actuator;
- the pressure in the extension chamber of the actuator;
- the pressure in the closing chamber of the valve of the pressure-maintaining means;
- the pressure in the opening chamber of the valve of the pressure-maintaining means; and
- the position of the slide in the valve of the pressure-maintaining means;

FIG. 3 is a hydraulic circuit diagram showing a variant embodiment of the invention; and FIG. 4 is a hydraulic circuit diagram showing another variant embodiment of the invention.

DETAILED DESCRIPTION OF THE INVENTION

Figure 1:
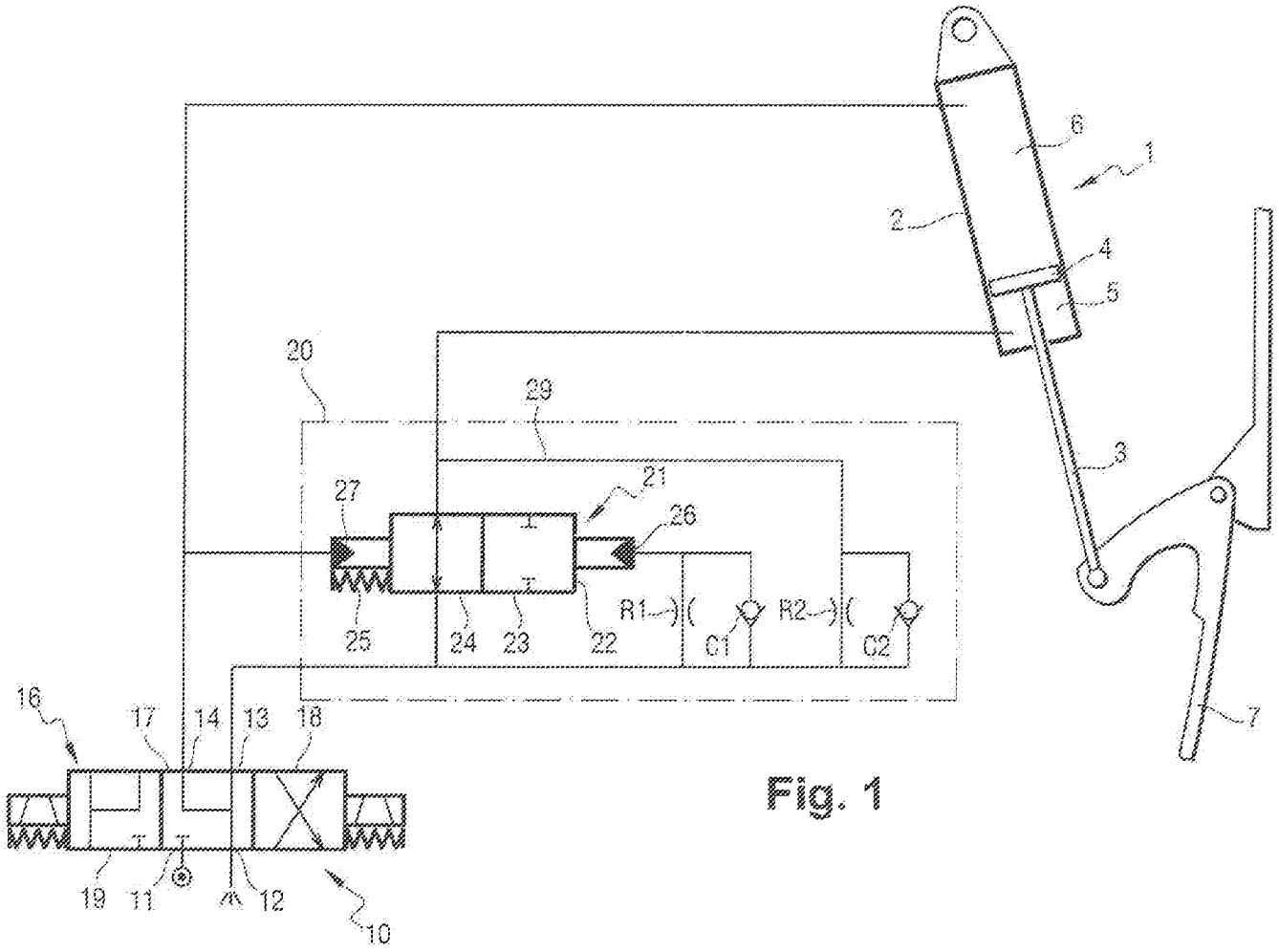
FIG. 1 is a hydraulic circuit diagram showing how an actuator for moving a door is fed by means of a hydraulic circuit of the invention.

The hydraulic circuit diagram shown in FIG. 1 is for feeding hydraulic fluid to an actuator 1 comprising a cylinder 2 in which a rod 3 slides by being associated with a piston 4 that defines within the cylinder 2 both a first, or retraction, chamber 5 (in this example, the annular chamber) and also a second, or extension, chamber 6 (in this example, the complete chamber). By way of example, the actuator 1 serves to move a door 7 of an aircraft wheel bay. In this example, the door is closed when the rod 3 of the actuator is in its retracted position. The two chambers 5 and 6 of the actuator 1 are fed with fluid under pressure by a slide valve 10 having a feed port 11, a return port 12, and service ports 13 and 14 connected respectively to the retraction chamber 5 and to the extension chamber 6 of the actuator 1. The slide valve 10 comprises a cylinder in which a slide 16 is slidably mounted. The slide 16 is urged towards a stable central position 17 by centering springs. In this position, the slide 16 connects both of the service ports 13 and 14 to the return port 12, such that both chambers 5 and 6 of the actuator 1 are connected to return. The slide 16 may be moved towards first and second extreme positions 18 and 19 on either side of the central position, such that:

in the first extreme position 18, the feed port 11 is connected to the retraction chamber 5 and the return port 12 is connected to the extension chamber 6, so as to pull on the door 7 in order to close it; and in the second extreme position 19, the feed port 11 is connected, in this example, to both chambers 5 and 6 of the actuator 1 in order to open the door. The rod 3 of the actuator 1 is then extended as a result of the differential action of pressure in both chambers 5 and 6.

The door 7 is generally held closed by means of a latch of a latching box (not shown) that hooks onto a roller of the door 7 in order to hold the door in a prestressed position against a closed abutment.

During a sequence of opening the door 7, it is known to begin by controlling the actuator 1 so that it pulls on the door 7 in order to offload the latch, thereby making the latch easier to disengage. Once the door 7 is unlatched, the actuator 1 is caused to push the door 7 and thereby open it. Thus, such a sequence involves placing the slide 16 of the valve 10 in the first position 18, and then in the second position 19. However, the slide 16 needs to pass through the central position 17, and the retraction chamber 5 runs the risk of suddenly losing pressure, and then of being pressurized once more when the slide 16 reaches the second extreme position 19. In order to avoid this drawback, and in accordance with the invention, pressure-maintaining means 20 are inserted in the hydraulic circuit for maintaining pressure in the retraction chamber 5 of the actuator while the slide valve 10 is passing from the first extreme position to the second extreme position.

The pressure-maintaining means 20 comprise an on/off valve 21 arranged in the pipe connecting the slide valve 10 to the retraction chamber 5. The on/off valve 21 has a slide 22 that is movable between a closed position 23 and an open position 24 towards which it is urged by a spring 25. The on/off valve 21 has two opposing pilot chambers for moving the movable slide 22 (which chambers are represented by the standardized black triangle symbol), these chambers comprising a closing chamber 26 connected to the service port 13 that is connected to the retraction chamber 5 of the actuator, and an opening chamber 27 connected to the service port 14 that is connected to the extension chamber 6 of the actuator.

The connection between the service port 13 of the slide valve 10 and the closing chamber 26 of the on/off valve 21 includes a constriction R1 and a check valve C1 connected in parallel, the check valve C1 allowing fluid to flow from the slide valve 10 towards the closing chamber 26. Finally, the pressure-maintaining means 20 include a hydraulic shunt 29 that connects the retraction chamber 5 of the actuator directly to the service port 13 by shunting the on/off valve 21 in such a manner that the retraction chamber 5 can be fed when the on/off valve 21 is closed. The shunt 29 includes a constriction R2 and a check valve C2 connected in parallel, the check valve C2 allowing fluid to flow from the slide valve 10 towards the retraction chamber 5.

Figure 2:
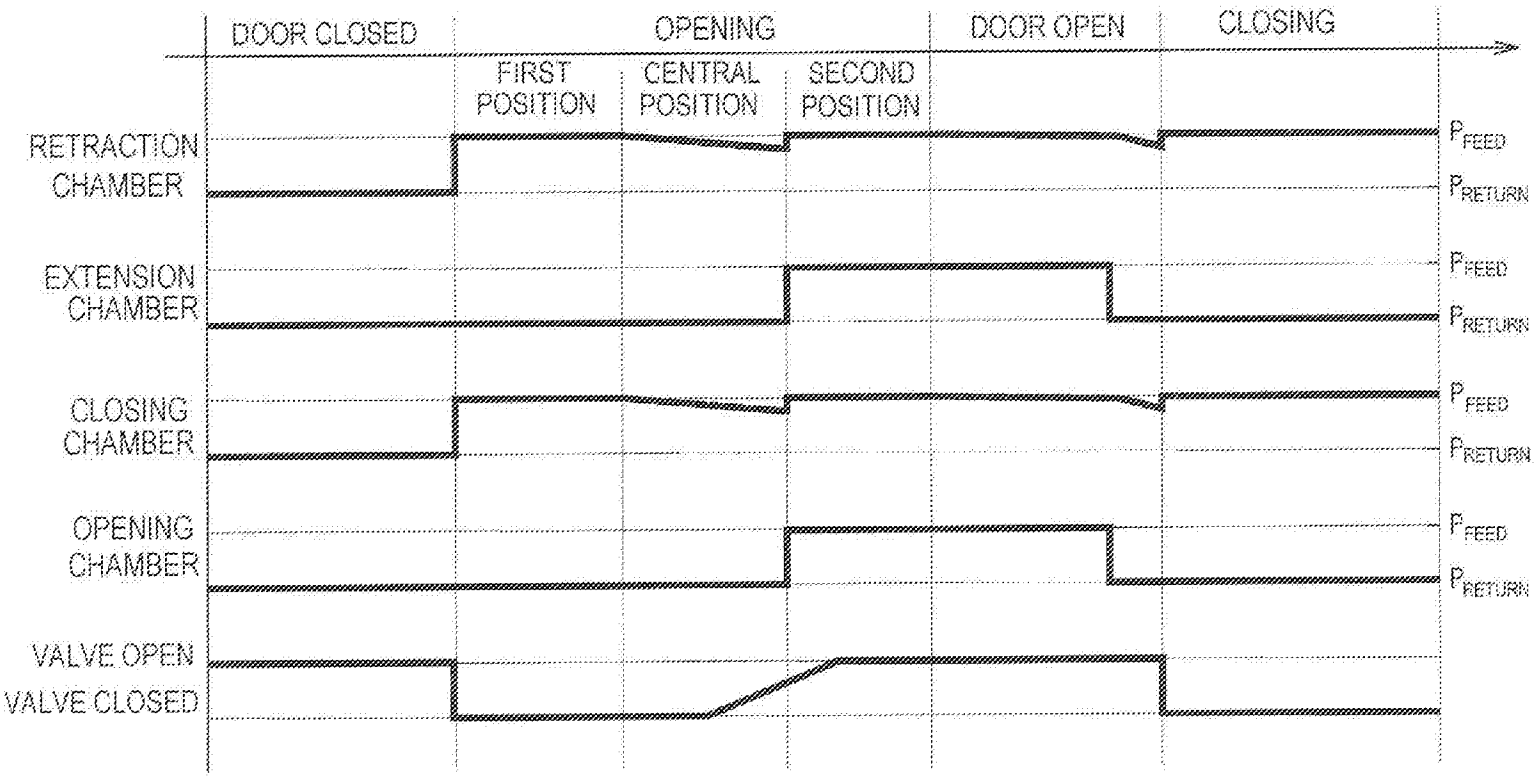
FIG. 2 is a timing chart showing various operating parameters of the hydraulic circuit of the invention during stages of opening and of closing the door, including.

The operation of the hydraulic circuit of the invention is described below with reference to FIG. 2, where the horizontal axis represents time and in which the various stages of an opening and closing sequence of a door on an aircraft are shown, which stages are as follows:

door closed: the slide 16 of the valve 10 is in its central position 17, and both chambers 5 and 6 of the actuator 1 are connected to return. The door 7 is latched. The slide 22 of the on/off valve 21 is returned by its spring 25 to the open position;

opening the door: the slide 16 of the valve 10 is initially taken to its first extreme position 18, thereby pressurizing the retraction chamber 5. The actuator 1 then exerts traction on the door 7. The door is unlatched, after which the slide 16 of the valve 10 is taken to its second extreme position 19 in order to open the door 7, with the pressure in the retraction chamber 5 being maintained, in a manner that is described in detail below. The actuator 1 pushes the door 7 as far as its open position. This stage is described in greater detail below;

door open: the slide 16 of the valve 10 is held in the second extreme position 19. Both chambers of the actuator are pressurized. The actuator 1 is against its extension abutment;

closing the door: the slide 16 of the valve 10 is returned to the first extreme position 18, thereby connecting the extension chamber 6 to return. As above, the slide 16 passing through the central position 17 does not lead to sudden depressurizing of the retraction chamber 5. The actuator 1 pulls the door 7 and returns it to the closed position. The latch latches the door 7 so as to hold it in the closed position while prestressed against its closed abutment. Thereafter, the slide 16 of the valve 10 is returned to its central position 17, so that both chambers of the actuator 1 are connected to return.

There follows a detailed description of the opening stage. The opening stage is subdivided into three substages, defined by the position occupied by the slide 16 of the valve 10. In the first substage, the slide 16 of the valve 10 is placed in the first extreme position 18, thereby pressurizing the closing chamber 26 of the on/off valve 21, which closes against its spring 25. The fluid under pressure can nevertheless flow towards the retraction chamber 5 by passing via the shunt 29 and the check valve C2. The actuator 1 thus exerts a traction force on the door 7, thereby offloading the latch so that it can be disengaged more easily.

In the following substages, the slide 16 of the valve 10 is moved towards its second extreme position 19 by passing through its central position 17. It can be seen that when the slide 16 of the valve 10 is in the central position 17, the pressure in the retraction chamber 5 drops very slightly as a result of the fluid that can escape via the constriction R2 in the shunt 29, but it does not collapse suddenly. Thereafter, once the slide 16 of the valve 10 reaches the second extreme position 19, both pilot chambers 26 and 27 of the on/off valve 21 are connected to equal pressures. The pressure forces on the slide 22 of the on/off valve 21 balance and its slide 22 returns progressively under the action of the spring 25 towards the open position. The constriction R1 slows down this return movement so that the on/off valve 21 opens progressively, as shown. Both chambers 5 and 6 of the actuator are then pressurized and the actuator 1 pushes the door as a result of the differential action of the pressure in the two chambers. While waiting for the on/off valve 21 to open, fluid can nevertheless leave the retraction chamber 5 via the constriction R2.

Thus, as a result of the pressure-maintaining means of the invention, the retraction chamber 5 of the actuator is never suddenly depressurized while the slide 16 of the valve 10 is transiting from one extreme position to the other by passing through the central position, thereby avoiding any bouncing of the door and any pressure peaks in the circuit.

The invention can be embodied in various other ways. In FIGS. 3 and 4, the actuator 1 is operated in a non-differential manner for extending the rod 3. As shown in FIG. 3, a slide valve 10 is used in which the slide, when in its second extreme position 19, does not connect both chambers 5 and 6 of the actuator to the feed port 11, but connects only the extension chamber 6, with the retraction chamber 5 then being connected to the return port 12. The pressure-maintaining means thus serve to maintain the pressure in the retraction chamber 5 while the slide of the valve is in transit, and then once the extension chamber 6 is finally pressurized, the retraction chamber 5 sees its pressure decrease progressively as the on/off valve 21 opens, thereby once more avoiding any bouncing of the load. As shown in FIG. 4, the on/off valve 21 may include an auxiliary pilot chamber 28 likewise connected to the line going from the slide valve 10 to the extension chamber 6, but acting in parallel with the closing chamber 26.

The invention is not limited to the above description, but on the contrary covers any variant coming within the ambit defined by the claims.

In particular, although in the examples shown, the load is locked while the rod of the actuator is in its retracted position, it is naturally possible to apply the invention to a circuit feeding an actuator for which the load is locked while the rod is in its extended position. The first chamber is then the extension chamber and the second chamber the retraction chamber. In addition, the invention also applies to an actuator having a through rod.

The invention claimed is:

1. A hydraulic circuit for feeding an actuator, the circuit comprising a slide valve with a slide that is movable between first and second extreme positions on either side of a stable central position so that:

in the central position, the slide valve connects first and second chambers of the actuator to a return port;

in the first extreme position, the slide valve connects the first chamber to a feed port and the second chamber to the return port; and in the second extreme position, the slide valve connects the second chamber to the feed port, the first chamber being connected either to the feed port or to the return port;

the hydraulic circuit including pressure-maintaining means for maintaining pressure in the first chamber of the actuator while the slide is passing through the central position on being moved from the first extreme position to the second extreme position, the circuit being characterized in that the pressure-maintaining means comprise an on/off valve arranged on a line connecting the slide valve to the first chamber, the on/off valve including a slide that is movable between a closed position and an open position, and wherein the slide of the on/off valve is urged towards the open position by a spring, the on/off valve having two pilot chambers, including a closing chamber connected to the first chamber of the actuator and an opening chamber connected to the second chamber of the actuator.

2. A circuit according to claim 1, wherein a shunt extends between the slide valve and the first chamber in order to feed the first chamber with fluid under pressure when the slide of the slide valve is in the first extreme position and the on/off valve is closed.

3. A hydraulic circuit according to claim 2, wherein the shunt includes a check valve allowing fluid to return towards the first chamber of the actuator and a constriction in parallel with the check valve.

4. A hydraulic circuit according to claim 1, wherein the closing chamber of the on/off valve is connected to the slide valve by a connection including a check valve allowing fluid to pass to the closing chamber, and a constriction in parallel with the check valve.

* * * * *